United States Patent [19]

Conti

[11] 4,111,820

[45] Sep. 5, 1978

[54] COATING AND METHODS FOR PULLING CABLE AND DRAWING WIRE

[76] Inventor: Allen C. Conti, 4522 Turney, Cleveland, Ohio 44105

[21] Appl. No.: 839,077

[22] Filed: Oct. 3, 1977

[51] Int. Cl.[2] ..... C10M 1/06; C10M 3/04; C10M 5/04; C10M 7/08

[52] U.S. Cl. ..... 252/49.5; 72/42; 252/49.3; 252/52 R; 252/52 A

[58] Field of Search ..... 252/49.5, 52 R, 52 A, 252/49.3; 72/42

[56] References Cited

U.S. PATENT DOCUMENTS

| | | | |
|---|---|---|---|
| 3,000,826 | 9/1961 | Gililland | 252/49.3 |
| 3,983,042 | 9/1976 | Jain et al. | 252/49.3 |
| 4,045,362 | 8/1977 | Kuan et al. | 252/49.3 |

*Primary Examiner*—Irving Vaughn
*Attorney, Agent, or Firm*—Thomas H. Murray

[57] ABSTRACT

A coating consisting essentially of 0.5% to 50%, preferably 2% to 20%, by volume, polyethylene oxide and about 6% to 30% a dispersion agent selected from the group consisting of propylene glycol, glycerol, ethylene glycol, polypropylene glycol, diethylene glycol, triethylene glycol and hexylene glycol, with the ratio of polyethylene oxide-to-dispersion agent, by volume, being no greater than 2:1 and preferably 1:3. The remainder being essentially water. The coating is useful as a lubricant to facilitate pulling plastic-sheathed cable through a conduit, drawing wire through a die and mounting a tire on a rim. The coating is an emollient for wood and useful in metalworking to inhibit or otherwise control oxidation, and as an annealing and normalizing agent.

8 Claims, No Drawings

COATING AND METHODS FOR PULLING CABLE AND DRAWING WIRE

BACKGROUND OF THE INVENTION

This invention relates to a coating composition to protect and lubricate, if desired, the surface of an article without adversely affecting or otherwise degrading the physical properties of the article onto which the coating is applied. More particularly, the present invention relates to such a coating employed as a lubricant and/or wetting agent which can be applied directly onto the surface of a cable, wire or object to be pulled through a conduit, duct, raceway and die to facilitate the joining of two members together such as mounting a pneumatic tire upon a rim or press-fit operation.

While not limited thereto, the coating of the present invention is particularly useful to form a coating of lubricant on wire and/or cable to facilitate pulling operations through a die, conduits and/or ducts. During such pulling operations, the ever-present problem of friction occurs between the outside surface of the object being pulled and the inside surface of the passageway. From an economic standpoint, it is desirable to use the longest possible length of cable or wire during a single pull through the conduit, duct or die. However, as the length of cable or wire involved in a single pull increases, there is a corresponding increase to the necessary pulling force imposed on the cable or wire. If an excessive pulling force is developed, the cable or wire elongates beyond an allowable value causing fractures or breaks to occur. After a cable is drawn into a conduit or raceway, it is frequently necessary to move the cable in a reverse direction to facilitate dressing operations to the surface of the cable sheathing. Back and forth adjustments to the position of cable within a conduit is required when the preselected lengths of cable have their ends pre-equipped with a system of connectors.

In the past, a thixotropic paraffin-based gel, or petroleum-based lubricant was applied by hand onto the surface of the cable preparatory to the pulling operation. An applicator system such as is disclosed in U.S. Pat. No. 4,028,473, eliminated much of the labor and mess usually associated with manual application of the lubricant onto the cable. However, a heavy residue of lubricant remains on the surface of the cable whereby the necessary splicing operations were impeded because of the residue particularly in an underground environment.

Instead of a thixotropic paraffin-based gel or petroleum-based lubricant, there is disclosed in U.S. Pat. No. 3,925,216, a lubricant comprised of polyethylene oxide in an alcohol-water solution. Such a lubricant will eliminate much of the clean-up operations because it provides a desirable property of rapid evaporation. However, this lubricant has inferior friction-reducing properties as compared to a thixotropic gel, particularly in regard to the necessary cable dressing operations and back and forth adjustments of the cable when using selected lengths with pre-prepared connectors. A lubricant of polyethylene oxide in an alcohol-water solution will rapidly evaporate and is highly water-soluble whereby little lubricant, if any, remains after the pulling operation is completed. However, this lubricant composition can be useless or ineffective when the ductwork contains or is filled with water as frequently occurs when the ductwork is underground.

In a wire- or rod-drawing operation, a protective coating is necessary to prevent exposure to oxidizing air and thereby minimizes the formation of scale which quickly wears dies out of shape as well as spoiling the workpiece. Pickling and a water rinse usually precede the drawing operation. Ordinarily, greasy lubricants are ineffective to protect the die because such lubricants do not adhere to an aqueously-wet surface of the workpiece. In the regular wire-drawing practice, the workpiece is coated with the liquor or soap solution just prior to the actual drawing operation by submerging the workpiece in the solution until the workpiece is drawn through the die. Liquor or soap solutions do not form a sufficiently thick lubricant film on the workpiece.

SUMMARY OF THE INVENTION

It is an object of the present invention to provide a novel coating composition consisting essentially of an aqueous solution of a dispersion agent and polyethylene oxide and a particular use thereof for cable-pulling operations, metalworking and controlled oxidation of drawing wire.

It is a further object of the present invention to provide a novel coating composition formed as an emollient for wood and a release agent used in a mold for curing a tire.

It is a further object of the present invention to provide a gel-like, semi-liquid coating having a novel composition which is non-degrading to sheathing for cable made of polyethylene or polyurethane material; will not readily evaporate at warm outdoor temperatures; will not freeze at outdoor sub-freeqing temperature; and viscoelastic, yet removable, with a water flush to enable handling of a coated element.

The coating solution according to the present invention essentially consists of about 0.5% to 50% by volume polyethylene oxide and about 6% to 30% by volume a dispersion agent selected from the group consisting of propylene glycol, glycerol, ethylene glycol, polypropylene glyocol, diethylene glycol, triethylene glycol and hexylene glycol, the ratio of the volume of polyethylene oxide to the volume of a dispersion agent being no greater than 2:1 and the remainder being water. Polyethylene oxide, by volume, is preferably within the range of 2% to 20%. For wire-drawing operations, it is preferred to add to the coating composition, by volume thereof, up to 15% lime. In still other terms, the coating of the present invention essentially consists of at least about 2 parts by volume a dispersion agent selected from the group consisting of propylene glycol, glycerol, ethylene glycol, polypropylene glycol, diethylene glycol, triethylene glycol and hexylene glycol, and 1 part by volume polyethylene oxide and at least about 4 parts by volume water. However, 3 parts by volume of the dispersion agent, propylene glycol, are preferred.

The present invention further provides a method for pulling cable including a protective sheathing of polyethylene or polyurethane through a conduit, duct or the like wherein the method includes the steps of applying to the outer surface of the sheathing a non-degrading lubricant consisting essentially of the coating as defined hereinabove and then drawing the cable in the conduit while the coating remains on the outer surface of the sheathing.

The novel coating composition of the present invention has been found particularly useful for pulling underground power, electric or telephone cables of the type which include metal conductors or glass fiber.

When such cable is protected by polyethylene or polyurethane sheathing, many lubricant coatings are effective. However, it is very important that a lubricant compound does not adversely affect the sheathing. Degrading of the sheathing material as by, for example, increasing the stress cracking potential will allow water and elements to adversely affect the transmission medium causing disruptions of service and damage to the cable. The unique group of dispersion agents used in the lubricant composition of the present invention as well as the component of polyethylene oxide are non-degrading to such sheathing materials. However, it has been found that the use of alcohol as disclosed in U.S. Pat. No. 3,925,216 as a component in a lubricant can adversely affect a sheathing of polyethylene and polyurethane materials.

In wire-drawing operations, viscoelasticity and water-solubility properties of the novel coating enable use thereof as a lubricant and to control oxidation as well as preventing scale formation on the coated surface of the workpiece. In a press-fitting or joining operation, the coating has an excellent friction-reducing property to enable closer tolerance fits than would normally be enabled. In a tire-mounting operation, the ability of the coating composition to adhere to the beaded portion of a rubber tire and the metal rim insures significant reduction in friction and renders the coating superior for this application. Moreover, the coating also functions to establish and maintain a seal between the tire and rim to inhibit air leakage.

DETAILED DESCRIPTION

For drawing wire from workpieces of brass, copper or ferrous metals, the preferred coating composition consists essentially of 3 parts by volume the dispersion agent, propylene glycol, and 1 part by volume polyethylene oxide with an average molecular weight of 4,000,000, and between 9 to 50 parts water. By volume, the dispersion agent forms between 23% and 6% of the coating and polyethylene oxide forms between 9% and 2% of the coating. When the coating is applied to a workpiece by a drip method, then 35 to 50 parts water by volume is used to assure flowability. When a workpiece is dipped in a bath of the coating, about 9 parts by volume water is used to form the coating. The propylene glycol and polyethylene oxide are admixed together to form a slurry. The water constituent is either added to the slurry or the slurry is added to water. In either event, mixing is achieved after about 25 seconds of rapidly stirring the mixture at about 1150 revolutions per minute. The composition is allowed to set for 24 hours to permit the release of entrapped air. The resulting lubricant composition is extremely viscoelastic. The preferred dispersion agent of propylene glycol of the coating has a good lubricating property. However, it has been found according to the present invention that a dispersion agent constituent of the coating may be selected from the group consisting of propylene glycol, glycerol, ethylene glycol, polypropylene glycol, diethylene glycol, triethylene glycol and hexylene glycol. For this group of dispersion agents, propylene glycol is especially useful as the dispersion agent because it is miscible with water, a non-solvent of polyethylene, and a freezing point lower than water, e.g., −60° F. in a 60% by volume solution, friction-reducing agent, viscosity stabilizer, biodegradable, environmentally safe, non-toxic non-destructive to plastics, rubber and metals. A suspension of polyethylene oxide in propylene glycol and the latter-addition of water increases synergistically the viscoelasticity and lubricity of the solution.

The same mixing procedure is followed for all coating compositions including the preferred coating composition used for cable-pulling operations. The coating for this purpose consists essentially of 3 parts by volume propylene glycol, 1 part by volume polyethylene oxide and 9 to 40 parts, but preferably 25 parts, by volume, water. Thus, by volume, the dispersion agent, propylene glycol, is between 23% and 7%, but 10% is preferred; while polyethylene oxide is between 9% and 2%, but about 4% is preferred.

In the coating composition of the present invention, the water component reduces the ultimate thickness of the mixture. When compounding, the water component may be at any temperature except boiling. It is preferred to use ordinary tap water at room temperature. The suspension medium, i.e., propylene glycol, acts as a dispersion agent whereby the ratio of polyethylene oxide to propylene glycol by volumes can go from a minuscule amount of polyethylene oxide to an upper limit of 2 parts polyethylene oxide to 1 part propylene glycol. At this ratio of 2:1, a dispersion will still be effective. However, if the ratio of 2:1 is exceeded and water is added, the slurry forms into globules that resist further mixing without a decrease to the viscoelasticity of the mixture. Special equipment and mixing techniques are necessary to dissolve polyethylene oxide without a dispersion agent in water. As the polyethylene oxide hydrates, special mixing procedures are necessary to avoid shear which is a rupture of the chain link formed with water.

For joining operations, such as mounting a rubber tire onto a metal rim, the preferred coating composition consists essentially of 3 parts by volume propylene glycol, 1 part by volume polyethylene oxide and between 26 and 50 parts by volume water. An extremely effective lubricant is provided by this composition which is relatively inexpensive. The dispersion agent, propylene glycol, in this coating composition forms between 10% to 6% by volume and polyethylene oxide forms between 3% and 2% by volume. For press-fitting operations, the preferred coating composition is 3 parts of the dispersion agent, propylene glycol (between 37% and 23%) by volume, 1 part polyethylene oxide (between 12% and 9%) by volume and 4 to 9 parts, preferably 7 parts, by volume water. The coating composition, when used as a mold release agent in a tire-curing mold, consists of 3 parts (23% to 10%) by volume the dispersion agent, 1 part (9% to 3%) polyethylene oxide and 9 to 25 parts by volume water.

Polyethylene oxide is commercially available under the trademark POLOX from Union Carbide Corporation with the preferred average molecular weight being sold under the designation POLYOX WSR-301. Ranges of 0.5% to 50% polyethylene oxide (POLYOX) are tolerable in the coating composition of the present invention. Within this range, the viscoelasticity of the lubricant increases to a non-pourable substance at about 50% by volume polyethylene oxide. It has been found that the lubricity of the coating composition is approximately the same for all of the various mixtures but the ideal ranges of the components for a particular application have been expressed herein. It has been found that the lubricity of the coating composition increases in a water environment through which an object coated with the lubricant is passed.

The coating composition of the present invention is an extremely effective wood emollient. When used for this purpose, the coating is composed of 2 to 3 parts (40% to 37%) by volume the dispersion agent, 1 part (20% to 12%) by volume polyethylene oxide and 2 to 4 parts by volume water.

In the field of metalworking, the coating of the present invention is an effective annealing and normalizing agent, a lubricant and coolant for workpieces during roughening and finishing operations, such as rolling and strip-finishing operations and as a rust and scale control agent. When the coating is used for metalworking of aluminum, copper and ferrous metals, the coating is comprised of 3 parts (30% to 23%) by volume a dispersion agent, 1 part (10% to 9%) by volume polyethylene oxide and 6 to 9 parts water by volume.

To control rust and scale formation, the coating was tested by heating a 24-inch rod of 1040 carbon steel until the color red was observed. One-half of the lengths of rod was dipped in a bath of coating consisting of 3 parts by volume propylene glycol, 1 part by volume polyethylene oxide and 9 parts by volume water. The coating tightly adhered to the rod surface. The rod was then placed in the open atmosphere and allowed to cool. The coated end cooled slower and required between 30 to 60 minutes longer to cool to room temperature as compared with the uncoated part of the rod. During the next 6 to 8 hours, the coated end underwent a slow oxidation, acquiring a rusty appearance. However, between 5 to 7 days later, the uncoated end oxidized to a heavy coating of rust whereas the appearance of the coated end remained essentially constant. The rod was then flushed with water. The coating and rusty appearance were flushed away from the coated end while the uncoated end retained the rust formation after flushing with water. The same test and results occurred with a coating comprising 3 parts by volume propylene glycol, 1 parts by volume polyethylene oxide and 6 parts by volume water. In other tests, the rod was not heated but the same results were obtained with both coating compositions.

Although the invention has been shown in connection with certain specific embodiments, it will be readily apparent to those skilled in the art that various changes in composition can be made without departing from the spirit and scope of the invention.

I claim as my invention:

1. A lubricant and/or protective coating for an article, said coating consisting essentially of about 0.5% to 50% by volume polyethylene oxide and about 6% to 30% by volume a dispersion agent selected from the group consisting of propylene glycol, glycerol, ethylene glycol, polypropylene glycol, diethylene glycol, triethylene glycol and hexylene glycol, the ratio of the volume of polyethylene oxide to the volume of said dispersion agent being no greater than 2:1, and the remainder being water.

2. The coating according to claim 1 wherein said polyethylene oxide is within the range of 2% to 20% by volume.

3. The coating according to claim 1 further consisting essentially of up to about 15% by volume lime.

4. A lubricant and/or protective coating for an article, said coating consisting essentially of at least about 2 parts by volume a dispersion agent selected from the group consisting of propylene glycol, glycerol, ethylene glycol, polypropylene glycol, diethylene glycol, triethylene glycol and hexylene glycol, and 1 part by volume polyethylene oxide and at least about 2 parts by volume water.

5. The coating according to claim 4 consisting essentially of 3 parts by volume propylene glycol and at least 4 parts by volume water.

6. A method for drawing wire using a ferrous, copper or brass workpiece, said method including the steps of:

controlling oxidation of the workpiece surface while inhibiting the formation of scale thereon by coating the workpiece with a solution consisting essentially of about 0.5% to 50% by volume polyethylene oxide and about 6% to 30% by volume a dispersion agent selected from the group consisting of propylene glycol, glycerol, ethylene glycol, polypropylene glycol, diethylene glycol, triethylene glycol and hexylene glycol, the ratio of the volume of polyethylene oxide to the volume of said dispersion agent being about 1:3 and the remainder being water, and using said coating as a lubricant while drawing the coated workpiece through a die.

7. The method according to claim 6 wherein said polyethylene oxide is within the range of 2% to 20% by volume.

8. The method according to claim 7 wherein said dispersion agent is propylene glycol and within the range of 23% to 6% by volume.

* * * * *